United States Patent [19]

Ory et al.

[11] Patent Number: 4,874,147

[45] Date of Patent: Oct. 17, 1989

[54] TRAY AND TOOL HOLDER ADAPTABLE TO STEPLADDERS

[76] Inventors: Raymond J. Ory, 7 N. Parkway Dr.; Paul Smeltzer, 8 N. Parkway Dr., both of Naperville, Ill. 60540

[21] Appl. No.: 181,677

[22] Filed: Apr. 14, 1988

[51] Int. Cl.[4] ..... E06C 7/14

[52] U.S. Cl. ..... 248/210; 182/129; 248/222.1

[58] Field of Search ..... 248/210, 238, 222.1, 248/223.4, 225.1, 213.2, 500, 154, 228; 182/129, 116; 292/86-88, 180, 152; 280/79.1 R

[56] References Cited

U.S. PATENT DOCUMENTS

| | | | |
|---|---|---|---|
| 2,473,951 | 6/1949 | Hickey | 248/210 X |
| 2,935,287 | 5/1960 | Higgins | 292/152 X |
| 3,822,049 | 7/1974 | Saunders | 248/223.4 X |
| 3,928,894 | 12/1975 | Berry et al. | 248/223.4 X |
| 4,167,271 | 9/1979 | Jorgensen | 280/79.1 R |
| 4,653,713 | 3/1987 | Hamilton | 248/238 |
| 4,706,918 | 11/1987 | Nelson | 248/210 |

*Primary Examiner*—Alvin C. Chin-Shue

[57] ABSTRACT

A utility tray having multiple compartments for retention of items such as nails, screws, washers and other small parts; and a pivoted lid to cover a single array of compartments, an upper mounting plate attached to the floor of the tray and a lower mounting plate facilitates mounting and demounting the tray and upper mounting plate to and from the uppermost platform of a foldable step ladder. The tray has bores that accept swiveling typecastor wheels that convert the tray into a wheeled, low profile tool and small parts retainer convenient for use in making under vehicle repairs or for use by tradesmen in home construction and remodeling.

5 Claims, 4 Drawing Sheets

10
12
14
14
16
18
20
24
42
44
A'
B'
B'
90
92
94
94
96
98
98
102
105
106
110
112
128
140
140
144
146
148
L
M
P

TRAY AND TOOL HOLDER ADAPTABLE TO STEPLADDERS

BACKGROUND OF THE INVENTION

The invention relates to a tool and small parts utility tray that attaches to a household or tradesmen ladder more commonly referred to as a folding stepladder. The tray fitted with furniture type swiveling castor wheel assemblies is also serviceable as a free rolling mechanics tool tray. It is believed that utility trays and support devices found in the prior art do not have the flexibility related to utility found in the instant invention. The prior art includes the following documents:

U.S. Pat. No. 4,460,063 discloses a work bench that attaches to the top step of a ladder. Attachment to the ladder is accomplished with the aid of a pair of hooks and two hingedly attached mounting arms pivotally connected to the ladder side rails in support of the bench.

U.S. Pat. No. 4,418,793 discloses a tray having an elongated central support means for the tray that is attached to one of the ladder side legs by means of a sleeve and set screw. The tray is height adjustable and can be used to support items against the ceiling. Storage of the device is cumbersome and the ability to support heavy objects on the tray is dependent on an individuals ability to securely tighten a set screw that secures the elongated support means at the desired height.

U.S. Pat. No. 4,318,523 discloses a utility support device for use with hollow rung ladders and is not adaptable to the common folding stepladder. The device or tray is also described as having downward extending sides which are not a positive means of retaining loose small parts such as screws and the like on the tray surface.

U.S. Pat. No. 2,749,008 teaches the combination of a ladder, other than a free standing foldable step-ladder, in combination with a platform pivotal from a folded configuration to a relatively horizontal fixed working configuration. The platform is further supported by struts attached to the parallel side rails of the ladder. Although advantageous to a person using such ladder for painting or other repair purposes, the platform is not readily detachable, lacks compartments and has utility only when used in conjunction with a ladder.

None of the above patents disclose a tray, platform or bench that is mountable and demountable to or from the upper platform of a folding stepladder. All of the above patents describe a tray or similar device that has utility only so long as it is used in conjunction with a ladder. A main object of this invention is to provide a novel combination of utility tray and attachments that will provide:

- a tray that is both easily attached to and removed from a free standing foldable stepladder,
- a tray in combination with attachments that is serviceable as a holder of tools and small parts such as screws, clips, and other similar components in a readily accessible and segregated manner,
- a tray that will serve as a low profile, wheeled, tool, and small parts tray for under vehicle use, and for in house repair or new construction by a tradesman as a wheeled tool and small components carrier.

DESCRIPTION OF THE PREFERRED EMBODIMENT

Figure 1:
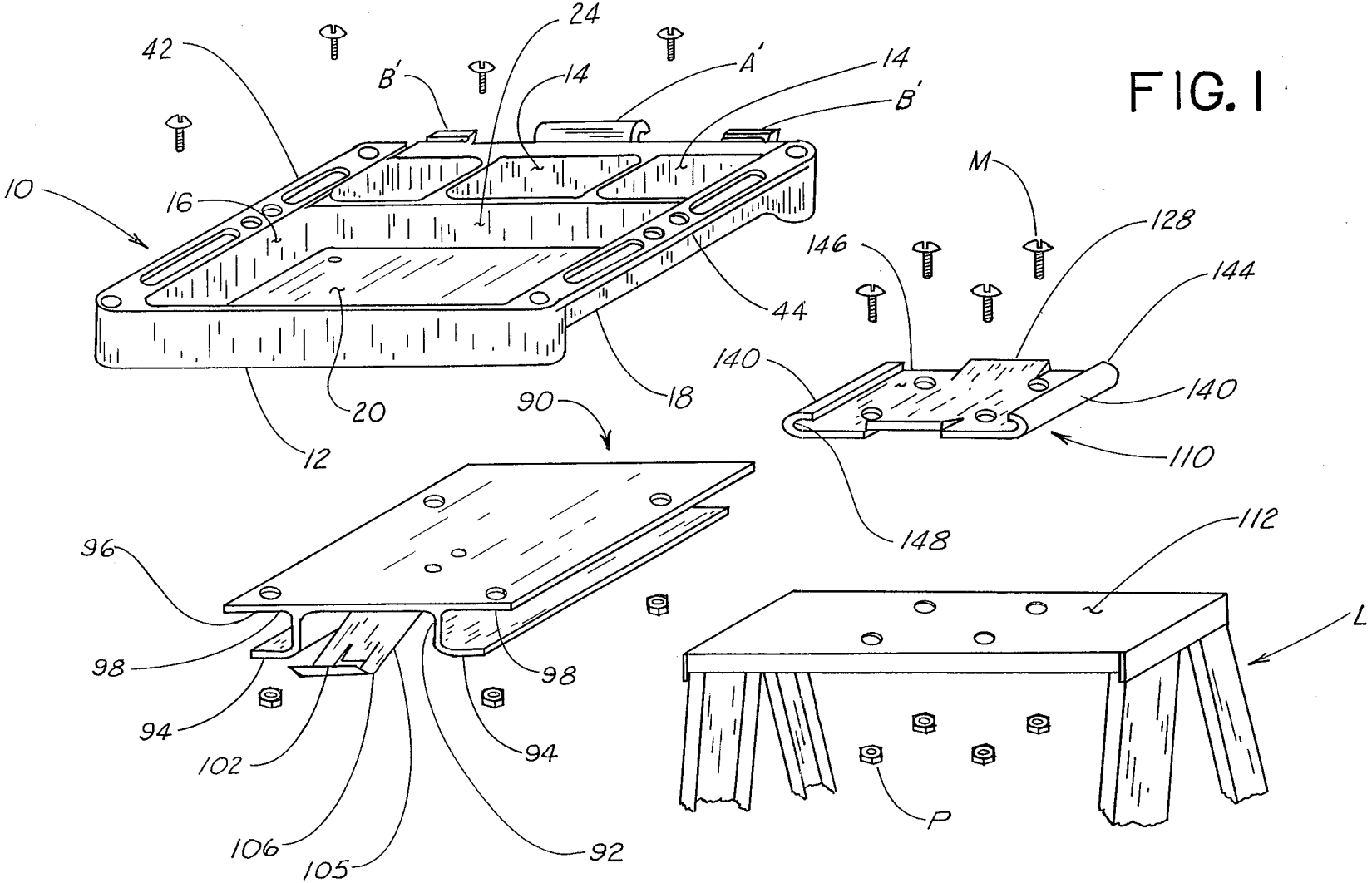
FIG. 1 is an exploded isometeric view of the preferred embodiment of the utility tray, and the associated upper and lower mounting plates. The view illustrates the means to attach the mounting plates to the tray and to the uppermost platform of an ordinary foldable stepladder, which is shown only partially in elevation.
Figure 3:
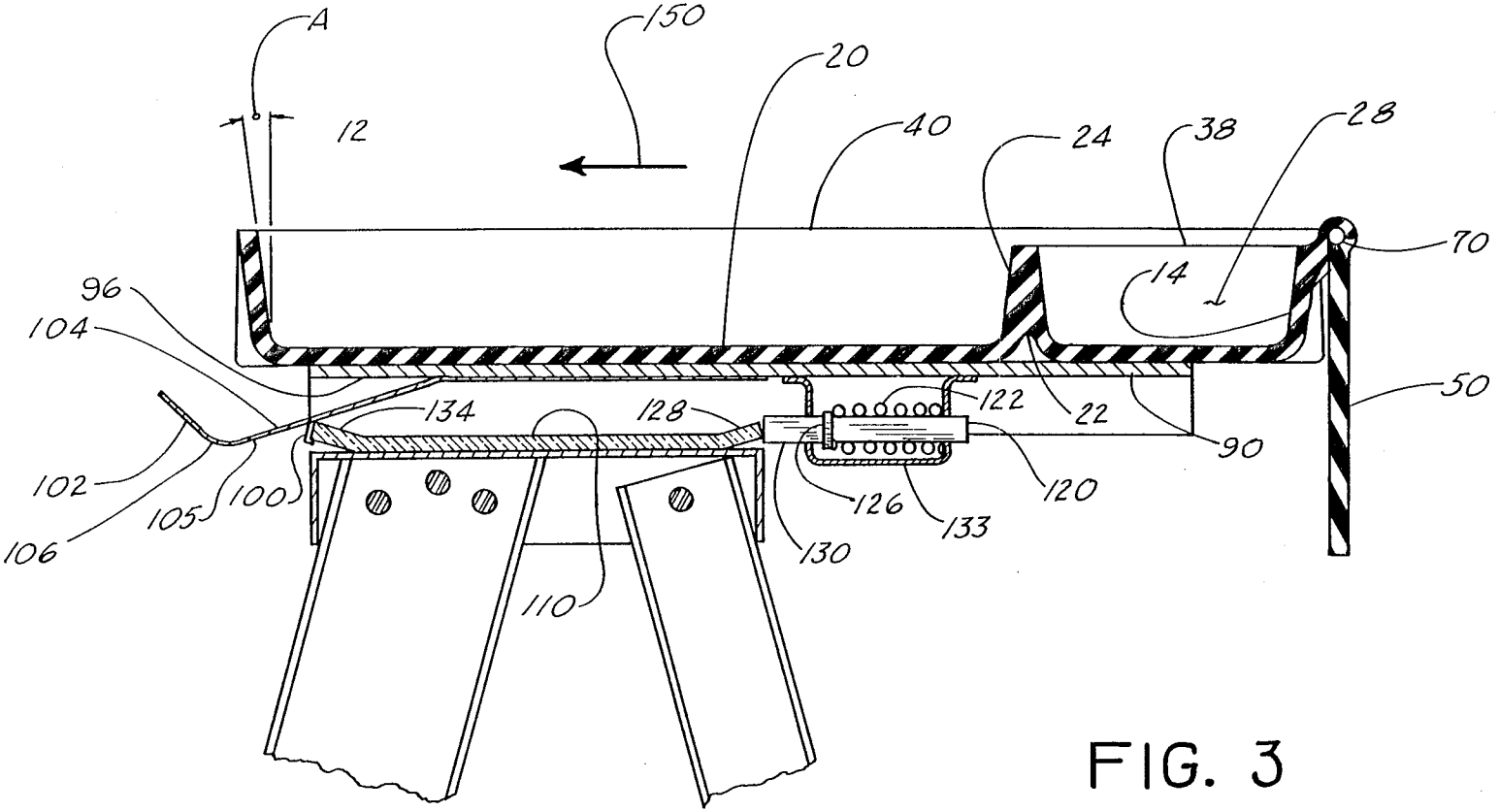
FIG. 3 is an elevational view in section of the tray assembly mounted to the uppermost platform of a stepladder.

In FIG. 1 a tool and small parts utility tray, designated generally at 10, is formed of a moldable high strength, impact resistant plastic material such as glass filled nylon. The tray 10 is formed with a floor panel integral with vertical wall portions, lateral flanges, and hinge elements. The vertical surfaces are formed with a minimal draft angle "A", as shown in FIG. 3, to facilitate demolding, a practice well-known in the plastic molding industry The tray 10 consists of first and second lateral wall portions 12, 14, and first and second longitudinal wall portions 16, 18 respectively. An integral planar floor panel 20 forms the base portion of the tray. An upward and lateral extending recess 22 interrupts the plane of the floor panel to facilitate the molding of drafted wall portions such as 24 shown in FIGS. 3 and 4.

Figure 2:
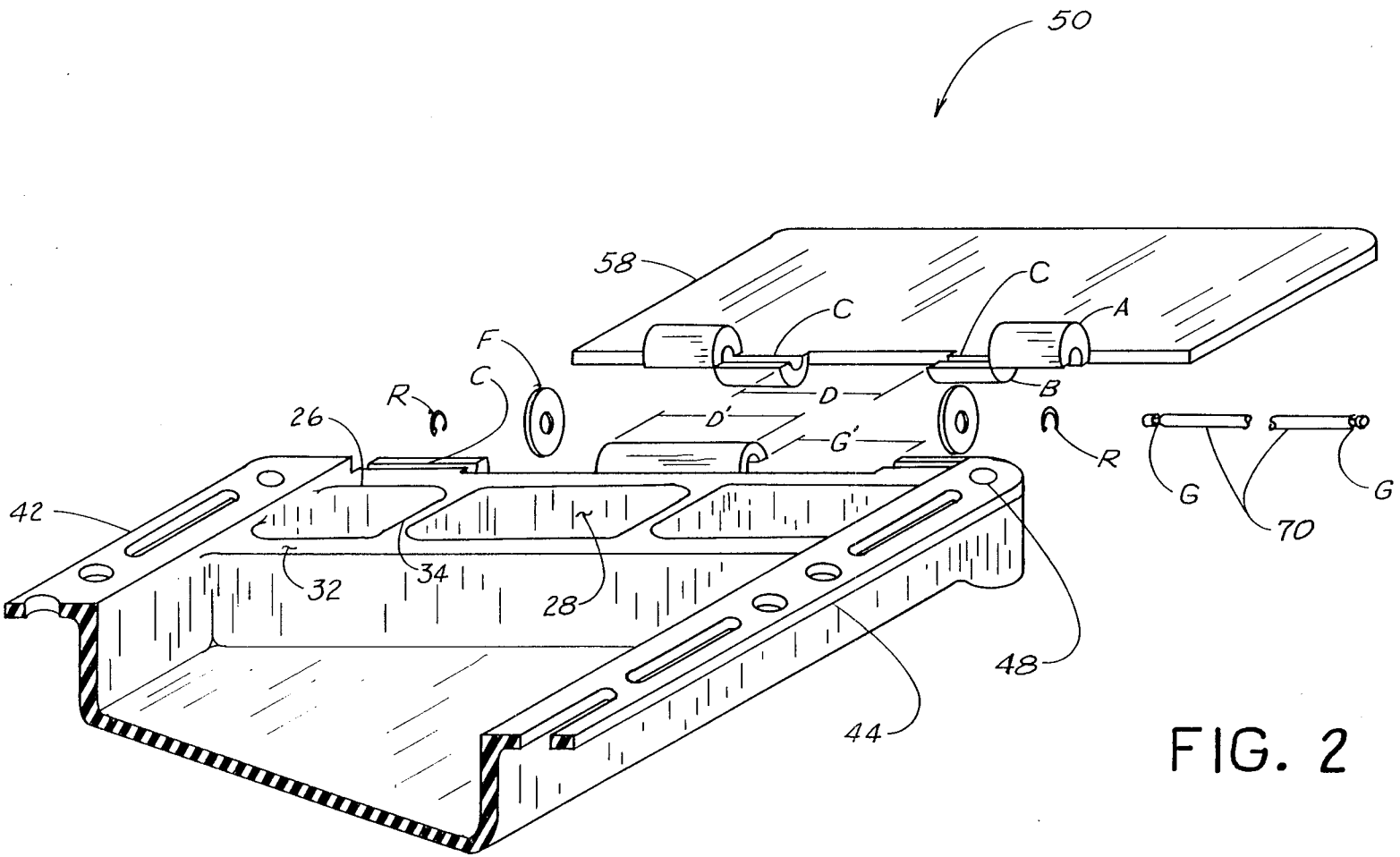
FIG. 2 is an isometric view of the molded closure lid and a fragmented isometric view of the tray, the closure lid hinge pin and "c" rings and flat washers.

A portion of the internal tray volume is divided into a lateral array of recessed compartments 26, 28, and 30 to accommodate and maintain, in a segregated manner, small parts such as screws, washers, nuts and the like As shown in FIG. 2, the recessed compartments are bounded by wall elements 14,24, 32,34,36 which terminate at their upper extremity and are coincident with plane 38. Plane 38 is parallel to and intermediate the plane of the floor panel 20, and also parallel to plane 40 as shown in FIG. 3. Plane 40 bounds the uppermost surfaces of the exterior vertically extending wall portions 12,16 and 18.

A molded plastic closure plate 50 as shown in FIGS. 2 and 3, is formed with integral, spaced apart, hinge element pairs 52 and 54 to provide hinged attachment to the upper edge of second lateral wall portion 14 of tray 10. Each hinge pair consists of an upper half cylindrical portion A, and a lower half cylindrical portion B. An axial channel C of semicircular cross section, concentric with the upper and lower cylindrical portions A and B and spaced outwardly and parallel to edge surface 56 of closure plate 50, slidingly and rotatably receives the elongated cylindrical hinge pin 70 at the time of assembly The semi-circular end face portions of the hinge elements A and B are perpendicular to the axis of the channel C. Two hinge elements B′ and a third hinge element A′ are formed as appendages of lateral wall portion 14 of the tray 10 as shown in FIGS. 1, 2 and 3. The hinge element A′ is similar in form to the hinge elements A associated with closure plate 50. Hinge element B′ is similar in form to the hinge element B of the closure plate. The two hinge elements B are spaced apart laterally a distance D which is approximately ten thousandths (0.010) of an inch greater than the length D' of hinge element A, and are equidistant from edge faces 58 of the closure plate. In a similar manner, the end face portion of hinge element A, is spaced apart from the end face portions of hinge elements B, The spaced apart distance G' being sufficient to receive the paired hinge elements A and B, in addition to the thickness of the flat washer F. In the assembled condition, flat washers F reside about the hinge pin 70 and in juxtaposition with the inboard end faces of hinge elements B' and the outboard end face portions of the closure plate hinge elements A. The flat washers F, so positioned during assembly of the tray 10 and closure plate 50 maintain the necessary lateral clearance between the end face portions of the hinge elements of the closure plate and those hinge elements A' and B' of the tray. Such clearance is necessary to provide proper hinge action and prevent interference between adjacent hinge elements during the pivoting of the closure lid about the hinge pin 70. The hinge pin is secured in its assembled state in relation to the hinge elements of the tray and lid by the application of snap rings R,R or the like to grooves G,G, formed in the end portions of the hinge pin 70 which extends beyond the outboard hinge elements B' of the tray 10. Referring to FIG. 1, first and second perforated lateral outwardly extending flange elements 42 and 44 extend outwardly from the upper edge of the oppositely facing longitudinal walls 16 and 18. A plurality of elongated perforations 46 are formed in each flange. The openings 46 are provided to accept tools such as screw drivers, pliers, or wrenches which have handles, or gripping elements that permit them to be inserted into the elongated slots. Tools can thus be stored in a convenient ready to use manner from the slotted flanges.

Figure 4:
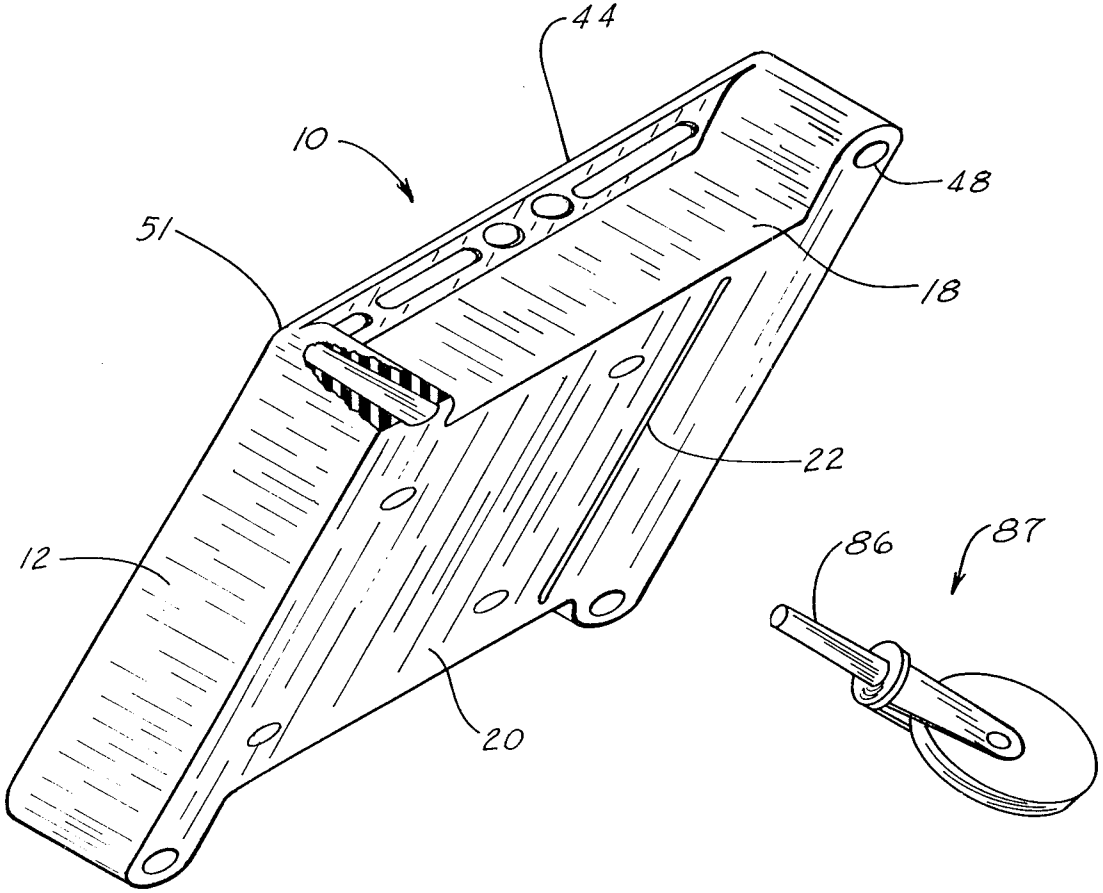
FIG. 4 is an isometric view of the utility tray under surface. A fragmented section of the tray depicts one of four bearing bores, located one at each of the four corners of the tray, each adapted to receive the shaft of a readily available castor type wheel assembly also shown.

Referring to FIG. 4, a bore 48 having open distal ends constitutes a vertical bearing sized to accept and cooperate with shaft 86 of a castor wheel assembly as designated at 87. An identical bearing is formed by surrounding wall portions 49 at each of the four exterior corners 51 of tray 10. Assembling a castor wheel to each of the four bearing bores 48 of the tray, provides a wheeled assembly for automotive mechanics and others to perform under vehicle repairs. A low profile, wheeled tool tray is a convenience when performing repairs on a vehicle that is supported on floor jacks and where the clearance between the underside of the vehicle and the floor is restricted to several feel. The tray fitted with the four castor wheels is easily positioned by the mechanic to any location within reach, while providing a selection of tools and other small components as may be needed.

The utility tray 10 as heretofore described is preferably attached by machine screws and threaded nuts to the upper mounting plate assembly 90 shown in perspective in FIG. 1, and in section in FIG. 3. The upper mounting plate 90 has two depending ribs 92 integral with the surface 96 as shown in FIG. 1. Each rib has an integral outwardly turned flange 94 forming a longitudinal "U" shaped channel section with rib 92 and the outer longituding edge portion 98 of the mounting plate 90.

A latch 105 attached to the lower surface of plate 90 is formed from an elongated rectangular thin strip of spring material 104. A catch 100, formed as a hook from the central portion of the strip 104, is biased downwardly and away from the lower surface 96 of the mounting plate 90. The free end 102 of the strip 104 is formed upwardly as is shown in FIG. 3. A camming surface 106 formed of end portion 102 causes the spring catch 100 to be cammed upwardly when the tray and base plate assembly are slidingly received by the mounting plate 110 as shown in FIGS. 1 and 3.

Again referring to FIG. 3, plunger 120 is biased outwardly of housing 132. The biasing force is generated by the coil spring element 122 which is installed and preloaded between the plunger shoulder 126 and the remote end wall 132 of the spring and plunger housing 133. The biasing force is delivered by the plunger 120 to the upwardly displaced lip 128, maintaining the catch 100 and the upwardly displaced lip portion 134 of the mounting plate 110 in intimate forceful contact, thereby securing the tray 10 and upper mounting plate assembly 90 in a predetermined slideably interlocked position relative to the lower mounting plate 110.

The lower mounting plate 110 is attached to the uppermost platform portion 112 of a stepladder L by machine screws M and nuts P as indicated in FIG. 1 and illustrated in FIG. 3. Longitudinal edge portions 140 of the mounting plate 110 join the longitudinal edge portion of surface 146 and the inwardly turned longitudinal flange portions 144. The resulting inwardly facing open "U" shaped channels 148 are thereby formed. The longitudinal opening of the channels 148 slidingly receive the outwardly turned flange portions 94 of the upper mounting plate 90, thereby preventing lateral and vertical displacement of the tray 10 and with respect to the lower mounting plate 110. The tray and upper mounting plate assembly can be decoupled or separated from the lower mounting plate and stepladder by applying a horizontal force, in the direction of the arrow 150, of sufficient magnitude to produce relative motion between the tray and lower mounting plate thereby overcoming the biasing force applied to plunger 120. The relative motion between the tray and the lower mounting plate will permit an upward force on latch lever 102 to disengage the catch 100 and lip 134, permitting the catch to ride over the lip 134 as the tray and base plate are permitted to move relative to the mounting plate in a direction counter to that indicated by arrow 150.

Having fully described the preferred embodiment of our invention, it is understood that variations in the composition of the materials of construction or in the configuration of the utility tray and mounting apparatus are possible without departing from the intent and purpose of the invention.

What is claimed is:

1. A tool and small parts utility tray with mounting plates comprising:

a rectangular tray having four exterior corners formed by the intersection of two lateral and two longitudinal exterior walls, a floor panel and interior wall elements defining open upwardly facing recessed compartments adapted to receive a closure plate hingedly attached to an upper edge of a lateral exterior wall, lateral outwardly extending flange elements attached to oppositely facing longitudinal exterior wall portions, open ended cylindrical vertical bearing surfaces formed and defined by surrounding wall portions rotatably received within said vertical bearing surfaces a shaft having a castor wheel assembly attached thereto, mounting plates comprising: an upper and a lower mounting plate for readily attaching and detaching said utility tray to a supporting surface; said upper mounting plate is rectangular in shape having a pair of length and a pair of width edge portions and an upper and a lower surface; a rib depending from the lower surface and adjacent each of said length edge portions of the plate, each of said ribs forming a longitudinal "U" shaped outwardly facing channel section; a latch with a hook shaped catch formed therewith, the latch attached to said lower surface of said upper mounting plate and a free-end extending outwardly beyond a first width edge portion of said upper plate, said hook shaped catch facing rearward toward the said second width edge portion and formed outwardly of said lower surface of said upper mounting plate; the latch being biased downward away from said lower surface of said upper mounting plate; a spring biased plunger residing within a spring and plunger housing have two end faces, said plunger housing attached to said lower surface of the upper mounting plate, parallel to and equidistant from the "U" shaped longitudinal channel sections, said plunger biased outwardly of a first end face of said spring and plunger housing and toward said latch; said upper surface of said upper mounting plate in contact with and attached to said floor panel of said utility tray; said lower mounting plate formed and having a rectangular shaped in plan, a "U" shaped inwardly facing upturned channel formed along two length edge portions of said rectangular lower mounting plate, a first and second lip formed upwardly and at the mid-point of each of two width edge portions of the lower rectangular mounting plate, said lower mounting plate attached to said supporting surface, wherein said outwardly facing "U" shaped channels of the upper mounting plate slidingly receive, in dovetail fashion, the inwardly facing channels of the lower mounting plate; said spring biased plunger forcibly urged inward of said spring plunger housing by moving contact with said first upwardly formed lip, downwardly biased latch of said hook engagingly capturing the second upwardly formed lip of the lower mounting plate thereby releasably locking said utility tray in a predetermined location relative to said mounting surface whereby the utility tray when detachedly removed from said supporting surface converts to a wheeled tool and small part utility tray.

2. In claim 1 wherein the interior wall elements terminate at their upper extremity in a plain horizontal surface to provide support for said hingedly attached closure plate, the closure plate providing cover for said recessed compartments, and thereby prevents the accidental spill and mixing of small parts contained within said recessed compartments.

3. In claim 1 wherein the utility tray and the closure plate are fabricated of a moldable plastic material and said latch is formed of a metallic spring material, thereby providing mass produceable, low cost durable components.

4. In claim 1 wherein the upper and lower mounting plates are formed of a lightweight mouldable, impact resistant material providing a durable close fitting slideable, interlocking mounted arrangement for the tray.

5. In claim 1 wherein a stepladders upper most platform constitutes the supporting surface, thereby extending the utility of said tray as ladder mounted tray and wheeled low-profile small parts and tool tray.

* * * * *